US005842878A

United States Patent [19]

Huag

[11] Patent Number: 5,842,878

[45] Date of Patent: Dec. 1, 1998

[54] SEALING STRUCTURE OF AN ELECTRICAL CONNECTOR

[76] Inventor: Shun-Feng Huag, No. 13, Lane 84, Na Fu Rd., Hsinchu City, Taiwan

[21] Appl. No.: 886,939

[22] Filed: Jul. 1, 1997

[51] Int. Cl.[6] ..... H01R 13/44

[52] U.S. Cl. ..... 439/139

[58] Field of Search ..... 439/145, 142, 439/139, 143

[56] References Cited

U.S. PATENT DOCUMENTS 4,395,082 7/1983 Rumble ..... 439/139

5,096,432 3/1992 Cullen et al. ..... 439/139

5,743,753 4/1998 Yen ..... 439/143

*Primary Examiner*—Neill Abrams

*Assistant Examiner*—Yong Ki Kim

*Attorney, Agent, or Firm*—Varndell Legal Group

[57] ABSTRACT

A sealing structure of an electric connector means, including a connector body having a flat circular head, the flat circular head having two slots adapted for receiving metal contact blades of an electric plug, a circular rotary cap covered on the flat circular head of the connector body and turned between a first position to close the slots of the connector body and a second position to open the slots of the connector body, and spring means connected between the connector body and the rotary cap to hold the rotary cap in the first position.

2 Claims, 5 Drawing Sheets

SEALING STRUCTURE OF AN ELECTRICAL CONNECTOR

BACKGROUND AND SUMMARY OF THE INVENTION

The present invention relates to a sealing structure of an electric connector which comprises a rotary cap turned between a first position to close the blade slots of the connector body, and a second position to open the blade slots of connector body.

Regular Christmas tree light sets are commonly equipped with electric connectors through which a plurality of Christmas tree light sets can be connected in series. These electric connectors must be well sealed when not connected. If these electric connectors are not well sealed when not connected, rain water may pass to the inside to cause an electric short circuit, or children may insert metal objects to contact the circuit, causing an electric shock.

The present invention has been accomplished to provide a sealing structure for an electric connector which eliminates the aforesaid problems. According to one aspect of the present invention, the sealing structure comprises a connector body having a flat circuit head, the flat circular head having two slots adapted for receiving metal contact blades of an electric plug, a circular rotary cap covered on the flat circular head of the connector body and turned between a first position to close the slots of the connector body and a second position to open the slots of the connector body, and spring means connected between the connector body and the rotary cap to hold the rotary cap in the first position. According to another aspect of the present invention, the connector body has a wire hole at one side and an electric wire extended out of said wire hole, and a jacket is watertightly mounted around the electric wire and tightly fitted into the wire hole to seal the gap.

DETAILED DESCRIPTION OF THE PREFERRED EMBODIMENT

Figure 1:
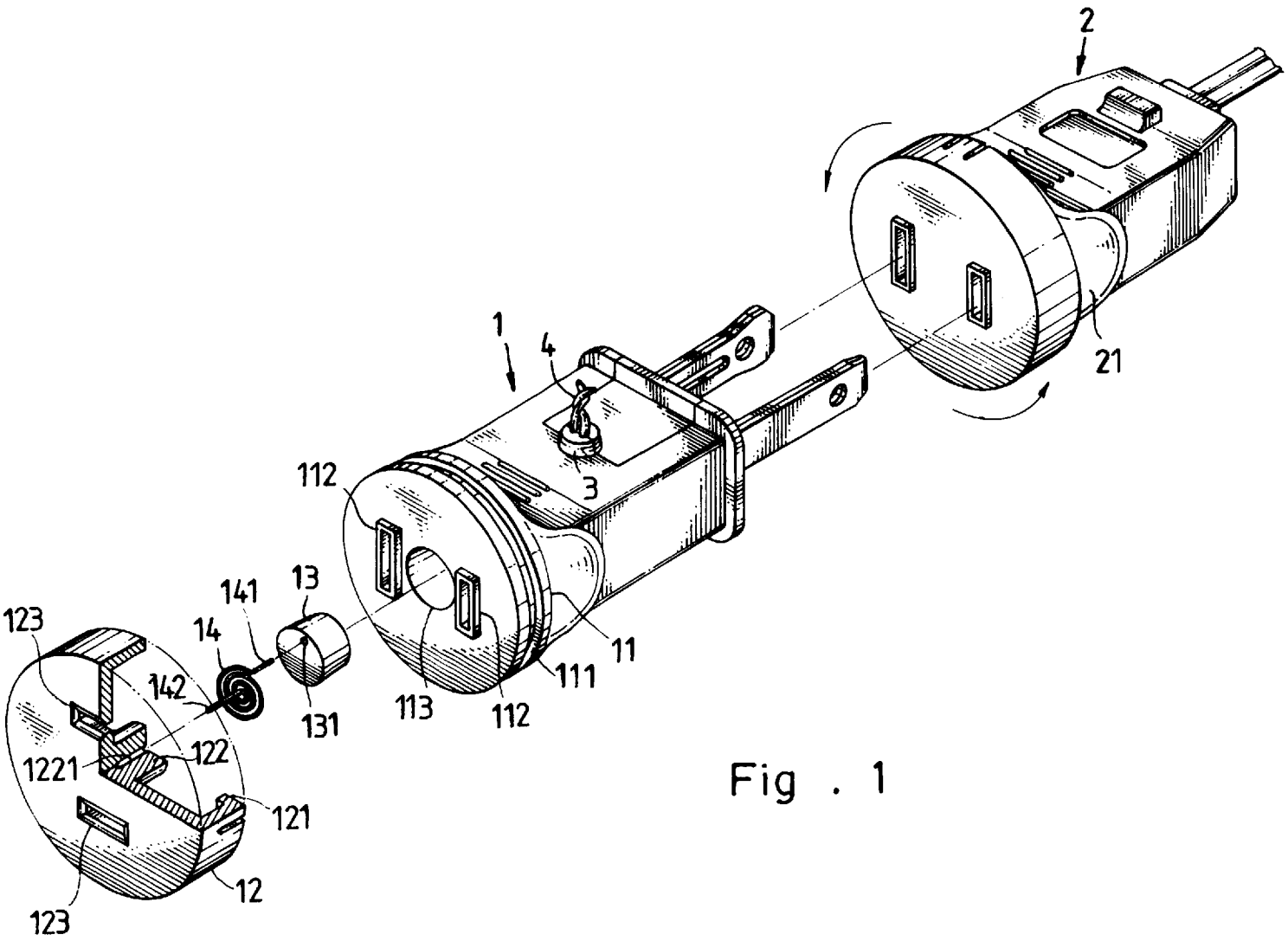
FIG. 1 is an exploded view of a first embodiment of the present invention.
Figure 2:
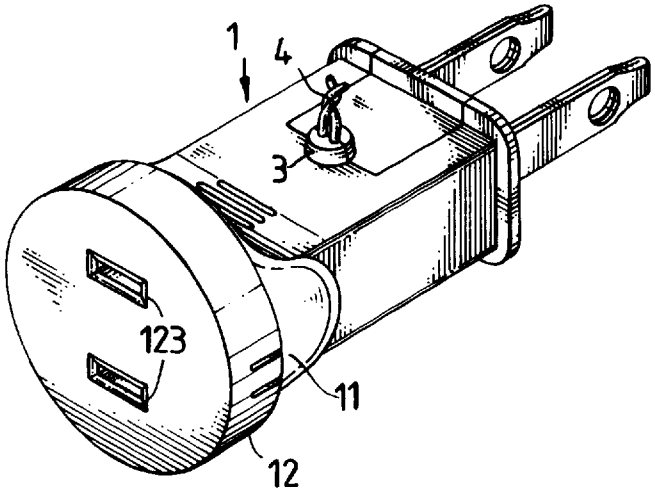
FIG. 2 is a perspective assembly view of the first embodiment of the present invention.
Figure 3:
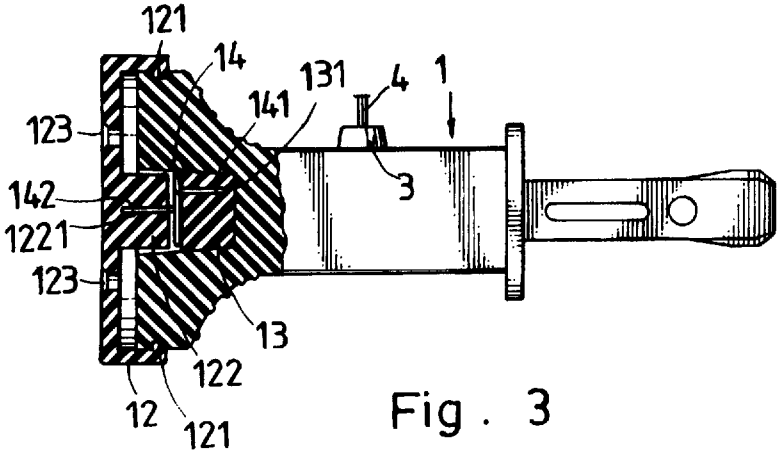
FIG. 3 is a sectional side view of the first embodiment of the present invention.
Figure 4:
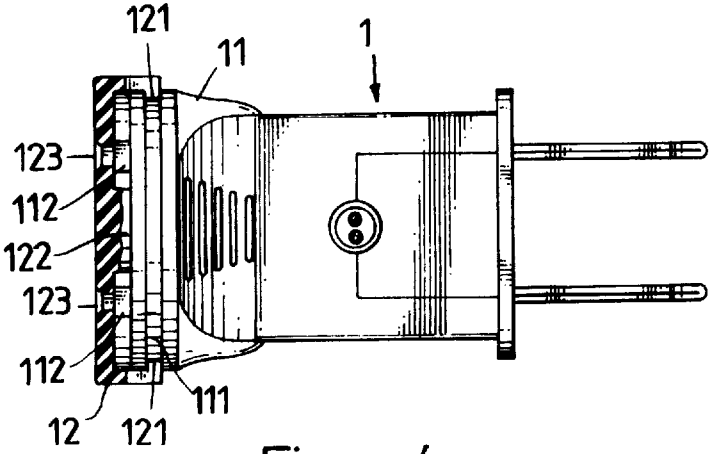
FIG. 4 is a sectional top view of the first embodiment of the present invention.

Referring to FIGS. from 1 to 5, the present invention can be employed to an electric socket 2 or electric adapter 1 to shield its head 11 or 21. As illustrated, the head 11 of the electric adapter 1 has a flat circular head 11, an annular groove 111 around the periphery of the flat circular head 11, a center locating hole 113 at the center of the flat circular head 11, and two slots (one hot slot and one neutral slot) 112 disposed at two opposite sides of the center locating hole 113 and adapted for receiving the blades of an electric plug. A circular rotary cap 12 is covered on the flat circular head 11 of the electric adapter 1, having an inside annular flange 121 coupled to the annular groove 111 of the flat circular head 11, a downward rod 122 perpendicularly raised from the center on the inside, a retaining hole 1221 disposed at the end of the downward rod 122, and two symmetrical slots 123 corresponding to the slots 112 of the flat circular head 11 of the electric adapter 1. A locating block 13 is fitted into the center locating hole 113 of the flat circular head 11 of the electric adapter 1, having a retaining hole 131 at its top side. A spiral spring 14 is coupled between the rotary cap 12 and the flat circular head 11 of the electric adapter 1, having one end 141 fastened to the retaining hole 131 of the locating block 13 and an opposite end 142 fastened to the retaining hole 1221 of the downward rod 122 of the rotary cap 12.

Figure 8:
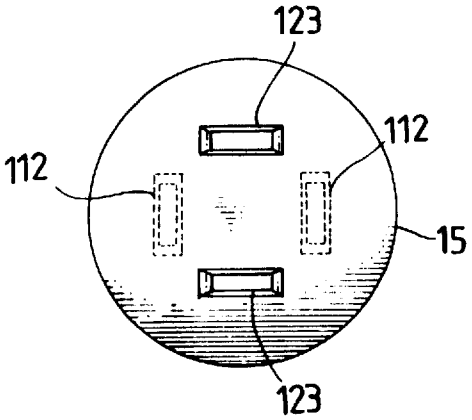
FIG. 8 is a front plain view of the present invention, showing the slots of the rotary cap biased from the slots of the flat circular head of the electric adapter.

Referring to FIG. 8, the spiral spring 14 imparts a spring force to the rotary cap 12, causing the rotary cap 12 to be retained in a shut-off position (in which the slots 123 of the rotary cap 12 are biased from the slots 112 of the flat circular head 11 of the electric adapter 1) to close the slots 112 of the flat circular head 11 of the electric adapter 1 (see FIG. 8).

Figure 5:
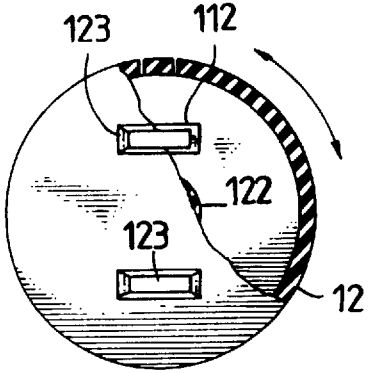
FIG. 5 is a front view of the first embodiment of the present invention, showing the rotary cap turned to the open position, the slots of the rotary cap moved into alignment with the slots of the flat circular head of the electric adapter.

Referring to FIG. 5 again, when in use, the user can rotate the rotary cap 12 to shift the slots 123 of the rotary cap 12 into alignment with the slots 112 of the flat circular head 11 of the electric adapter 1 respectively for the insertion of the blades of an electric plug. When the electric plug is removed, the spring force of the spiral spring 14 immediately returns the rotary cap 12 to its former shut-off position, and therefore the slots 112 of the flat circular head 11 of the electric adapter 1 are closed again (see FIG. 8).

Figure 6:
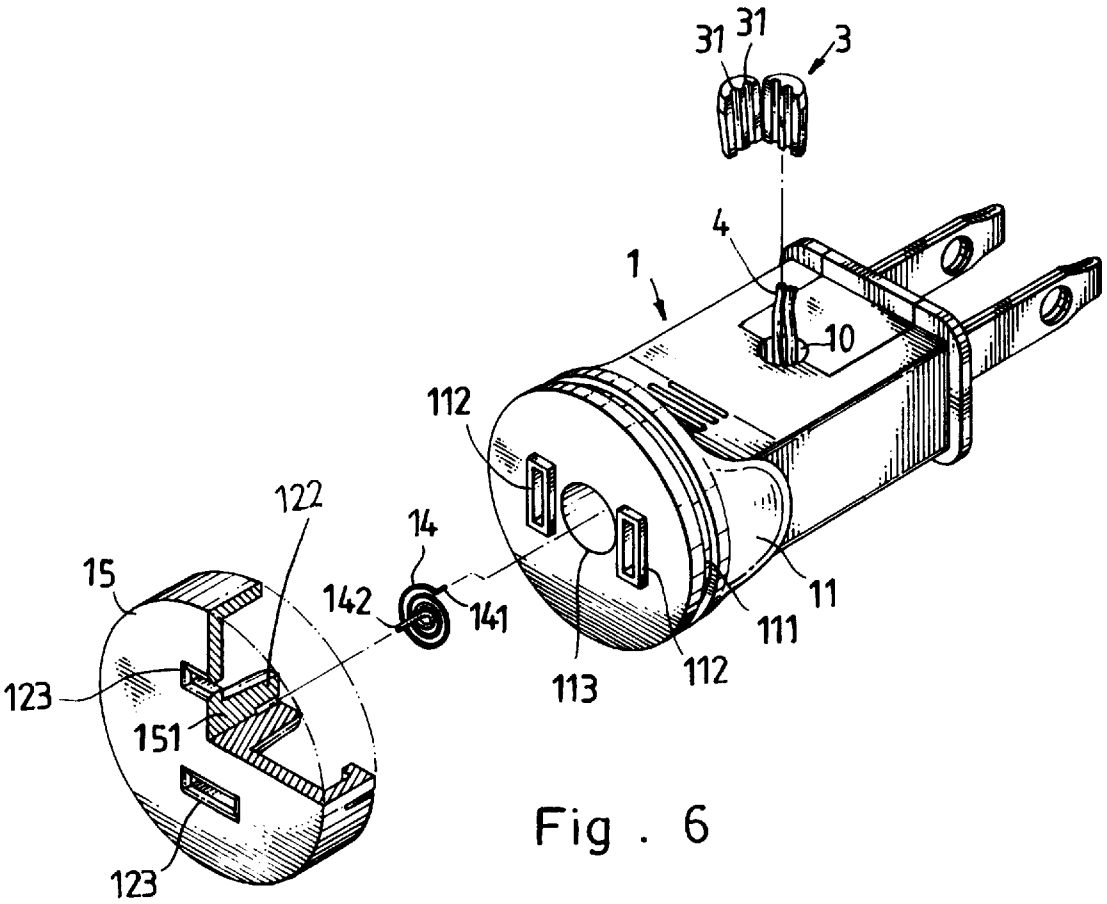
FIG. 6 is an exploded view of a second embodiment of the present invention.
Figure 7:
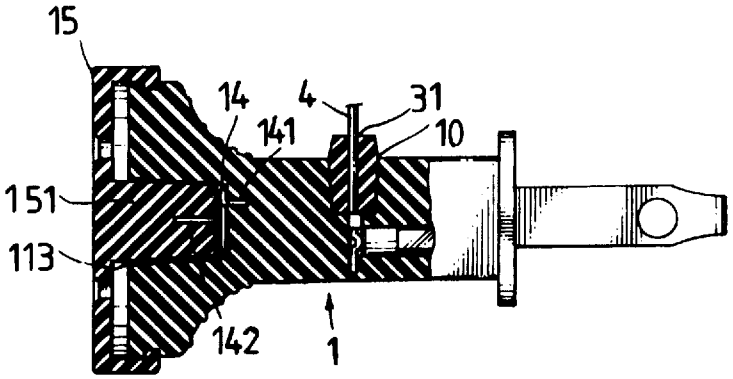
FIG. 7 is a sectional side view of the second embodiment of the present invention.

Referring to FIGS. 6 and 7, as an alternate form of the present invention, the rotary cap 15, has a long downward rod 122 perpendicularly raised from the center on the inside and inserted into the center locating hole 113 of the flat circular head 11 of the electric adapter 1 (see length of the downward rod 122 according to this embodiment is relatively longer than the downward rod 122 of the aforesaid first embodiment of the present invention), and the spiral spring 14 is mounted inside the center locating hole 113 and connected between the electric adapter 1 and the rotary cap 15 to hold the rotary cap 15 in the shut-off position. This embodiment eliminates the aforesaid locating block 13.

Referring to FIGS. from 1 to 8 again, in the aforesaid both embodiments, the electric adapter 1 has a wire hole 10 at one side and an electric wire 4 extended out of the wire hole 10, and a jacket 3 which is comprised of two hinged symmetrical halves with longitudinal grooves 31 is watertightly mounted around the electric wire 4 and tightly fitted into the wire hole 10 to seal the gap.

I claim:

1. A sealing structure of an electric connector means, comprising a connector body having a flat circular head, said flat circular head having an annular groove around the periphery, a center locating hole at the center, and two slots disposed at two opposite sides of said center locating hole and adapted for receiving metal contact blades of an electric plug, a circular rotary cap covered on said flat circular head of said connector body and turned between a first position to close the slots of said connector body and a second position to open the slots of said connector body, said rotary cap having an inside annular flange coupled to the annular groove of said flat circular head of said connector body and a downward rod aimed at the center locating hole of said flat circular head of said connector body, and spring means mounted in the center locating hole of said flat circular head of said connector body and connected between said connector body and said rotary cap to hold said rotary cap in said first position.

2. The sealing structure of claim 1, wherein said connector body having a wire hole at one side and an electric wire extended out of said wire hole; a jacket which is comprised of two hinged symmetrical halves is watertightly mounted around said electric wire and tightly fitted into said wire hole to seal the gap.

* * * * *